US005984776A

United States Patent [19]

Berger

[11] Patent Number: 5,984,776

[45] Date of Patent: Nov. 16, 1999

[54] REGISTER ASSEMBLY FOR COVERING AN AIR DUCT OPENING

[76] Inventor: Brian K. Berger, 431 Covert Ct., Ballwin, Mo. 63021

[21] Appl. No.: 09/015,432

[22] Filed: Jan. 29, 1998

[51] Int. Cl.[6] ..... F24F 13/28

[52] U.S. Cl. ..... 454/290; 55/491; 454/325

[58] Field of Search ..... 454/289, 290, 454/318, 325, 271, 273; 55/491, 493, 511

[56] References Cited

U.S. PATENT DOCUMENTS

| | | | |
|---|---|---|---|
| 637,519 | 11/1899 | Mertins | 55/491 X |
| 1,429,811 | 9/1922 | Tynan | 454/289 X |
| 1,841,347 | 1/1932 | Tuttle | 454/325 X |
| 1,911,851 | 5/1933 | Scholtz | 454/289 |
| 2,210,023 | 8/1940 | Candor . | |
| 2,575,499 | 11/1951 | Manow . | |
| 2,587,633 | 3/1952 | Levin | 454/289 |
| 3,220,079 | 11/1965 | Aggson | 454/271 X |
| 3,280,984 | 10/1966 | Sexton et al. | 55/491 X |
| 3,802,168 | 4/1974 | Deckas . | |
| 4,334,899 | 6/1982 | McConnell . | |
| 4,460,394 | 7/1984 | Wrightson | 55/491 |
| 4,900,344 | 2/1990 | Lansing . | |
| 5,100,445 | 3/1992 | Johnson et al. . | |
| 5,163,871 | 11/1992 | Huibregtse et al. . | |
| 5,176,570 | 1/1993 | Liedl . | |
| 5,472,380 | 12/1995 | Sarazen, Jr. et al. | 454/290 |
| 5,474,184 | 12/1995 | Mandler et al. . | |
| 5,597,392 | 1/1997 | Hawkins et al. . | |
| 5,643,081 | 7/1997 | Klein . | |
| 5,766,285 | 6/1998 | Killman | 55/385.6 |

FOREIGN PATENT DOCUMENTS

| | | | |
|---|---|---|---|
| 1344134 | 10/1963 | France . | |
| 165436 | 11/1933 | Switzerland | 454/325 |

*Primary Examiner*—Harold Joyce
*Attorney, Agent, or Firm*—Howell & Haferkamp, LC

[57] ABSTRACT

A register assembly for covering an air duct opening is comprised of a faceplate, a base, a damper mechanism and a filter frame that are easily assembled together. Most if not all of the component parts may be constructed of plastic reducing the manufacturing cost of the register assembly. The faceplate can be snapped onto the base or manually removed from the base without the use of fasteners or tools. The faceplate is replaceable, allowing the use of various ornamental designs of the faceplate grid on the same base containing the damper mechanism and filter frame. The filter frame is easily removed from the base to allow replacement or cleaning of the filter materials supported in the frame.

13 Claims, 5 Drawing Sheets

REGISTER ASSEMBLY FOR COVERING AN AIR DUCT OPENING

BACKGROUND OF THE INVENTION (1) Field of the Invention

The present invention pertains to a register assembly for covering an air duct opening in either the floor, wall or ceiling of a room. The register assembly may be employed with forced air heating and air conditioning systems and may also be employed in covering an air duct opening for a cold air return as well as other similar applications.

(2) Description of Related Art

There are many different types of registers employed in covering air duct openings. Many simply employ a faceplate having a grid or arrangement of louvers that cover over the air duct opening. Many have fixed louvers on their faceplates that direct and disperse air forced through the air duct opening whether heated air or cooled air. In some faceplates of this type, the louvers can be adjusted slightly to direct the air flow through the faceplate. Also, in some of these faceplates, the openings between the louvers can be closed off to stop the forced air through the faceplate.

Some prior art register assemblies include a base that is secured permanently with the faceplate and houses a damping assembly that functions to both block and unblock the flow of forced air through the base and also functions to provide some control over the direction at which the forced air passes through the faceplate of the assembly. These types of register assemblies are commonly used in covering over air duct openings in homes.

More recently, register assemblies have been developed that include a filter element that provides additional filtering of the air passing through the register assembly to the filtering of the air that occurs in the furnace or air conditioning system. Register assemblies have also been developed that include filters where the register assemblies are employed as cold air returns.

In addition, register assemblies have been designed with ornamental faceplates. These register assemblies are primarily intended for use in homes, however, many are finding use in the workplace where their ornamental appearance embellishes the work environment.

The many different types of register assemblies could all be improved upon by a register assembly designed to incorporate all of the desirable features of prior art register assemblies, i.e. a filter, a damping mechanism for regulating the air flow through the register assembly, and an ornamental faceplate. Such a register assembly could be further improved upon if the ornamental faceplate were detachable enabling selection from various different ornamental designs of faceplates to be used on the register assembly, and if the cost of manufacturing the register assembly was not significantly increased by the combination of all of these beneficial features into a single register assembly.

SUMMARY OF THE INVENTION

The register assembly of the present invention combines several of the beneficial features of prior art register assemblies into a single register assembly that, despite combining these beneficial features, remains relatively inexpensive to manufacture and purchase. In the preferred embodiment of the invention, most of the component parts are constructed of plastic, however, they can be constructed of wood, ceramic, metal and other similar types of materials.

The register assembly of the present invention is basically comprised of a base, a faceplate, a damper mechanism and a filter frame. In the preferred embodiment, the base, damper mechanism and filter frame are constructed entirely of plastic, and the faceplate may be constructed of plastic, wood, ceramic or metal such as brass, or other types of materials. The plastic construction of the base, damper mechanism and filter frame significantly reduces their cost of manufacture and their cost of purchase.

The marketing aspect is also a key benefit of this new design, for both the consumer and the retailer. The system greatly enhances floor space and selection. Twice as many registers can be offered in half of the floor space necessary for current displayed products. The faceplate can be hung on a peg board or displayed in shipping boxes. They will only take up approximately ⅜" to ¾" per unit compared to the traditional 2–2½" necessary for a fully assembled unit. The dampening systems are then displayed in bulk boxes, neatly nested together in half the space necessary for existing dampening systems. None of the dampening systems available on the market are offered separately. Even if they were, none can be stacked together for shipping to the manufacturer for assembly to the faceplate. The customer also has the option of not buying any dampening system at all. Many consumers do not adjust their air flow in certain rooms. The tabs on the bottoms of the units will keep the faceplates from sliding out of the opening if knocked. In addition, the consumer also has the option of purchasing the filtration system. This all works toward the most economical use of space and selection that is unavailable today.

The base is comprised of first and second pairs of side walls that are preformed in a boxlike configuration with a top opening and bottom opening providing access to the base interior. No assembly of the base is required. Holes are formed in the interior surfaces of a pair of opposed sidewalls between the top and bottom edges of the sidewalls. A number of pawls are formed in the interior surfaces of the other pair of opposed side walls and project a short distance toward the interior of the base. A narrow slot is provided through one of the sidewalls and lower shoulders and upper shoulders are formed in the interior surfaces of the base sidewalls with the upper and lower shoulders having spacings between them that correspond to the width of the slot.

The damper mechanism in the preferred embodiment is comprised of three dampers, however, the number of dampers could be increased and decreased depending on the size of the register assembly being manufactured. The dampers are flat generally rectangular members that have lengths that are slightly smaller than the length of the base interior and have combined widths that are slightly larger than the width of the base interior. Stub shafts project from the opposite ends of the damper lengths and are received in the holes in the opposite sidewalls of the base for pivoting movement. The stub shafts at one end of the damper mechanism each have an arm projecting therefrom. An actuator is connected to the distal ends of the arms. Dampers are preassembled into bases by the manufacturer and are shipped nested together to save space. The actuators are shipped separate and are later assembled to the dampers. Movement of the actuator in a generally linear motion results in pivoting movement of the dampers between open and closed positions in the base interior where they respectively unblock and block the flow of air through the base interior. The multiple louver system allows for easier and smoother operation of the damping mechanism. It also allows for the filtering system and faceplates to be installed on the damping system without having to make a deeper damper that may not fit in some openings.

The filter frame is constructed of first and second sections that are mirror images of each other and are connected together at one end by a hinge. Each frame section has a generally rectangular configuration defined by four borders of each section. Cross-braces extend between the section borders providing rigidity to each section. The two frame sections are folded over onto each other enclosing filter material between the sections. The filter material has the same rectangular configuration as the frame sections and may be any conventionally used filter material such as woven or spun fibrous material, loosely matted fiber material, a plastic foam or a paper material. With the filter secured between the two sections of the frame, the frame is inserted through the filter slot in the base sidewall and positioned between the upper and lower shoulders of the base extending across the interior of the base. The frame used for the filter material is made of more expensive and durable plastic. Unlike many of the cardboard holders for filter material, this frame and filter system can be washed and reused.

The faceplate may be constructed of plastic, wood, ceramic or metal such as brass, or other similar types of materials. It has a rectangular shape with generally flat top and bottom surfaces and has an ornamental grid surrounded by a border of the faceplate. One opening in the ornamental grid functions as an actuator opening for the damper mechanism actuator. A number of tabs equal to the number of base pawls project downwardly from the bottom surface on the faceplate. Each tab has a hole therein. The thickness of each tab is small giving the tabs a resiliency that enables them to flex inwardly. The faceplate is removably fastened to the base by pressing the face plate downwardly over the base top opening. This causes the tabs to slide downwardly over the base pawls which push the tabs inwardly until the pawls are aligned with the holes in the tabs. The pawls then snap into the tab holes, thereby removably securing the faceplate to the base over the base top opening by the snap-on connectors provided by the tabs and the pawls. Because the faceplate is easily removed from the base of the register assembly, a variety of different faceplates having different ornamental designs for their grids may be attached to the base enabling the purchaser of the register assembly to substitute different ornamental designs for the faceplate as desired.

Each of the component parts of the register assembly is designed so that they can be assembled together without the need for fasteners, spot welds, or other types of connectors, thereby significantly reducing the overall cost of the register assembly. In addition, when the component parts are constructed of plastic, their cost of manufacture and purchase is further significantly reduced.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENTS

Figure 1:
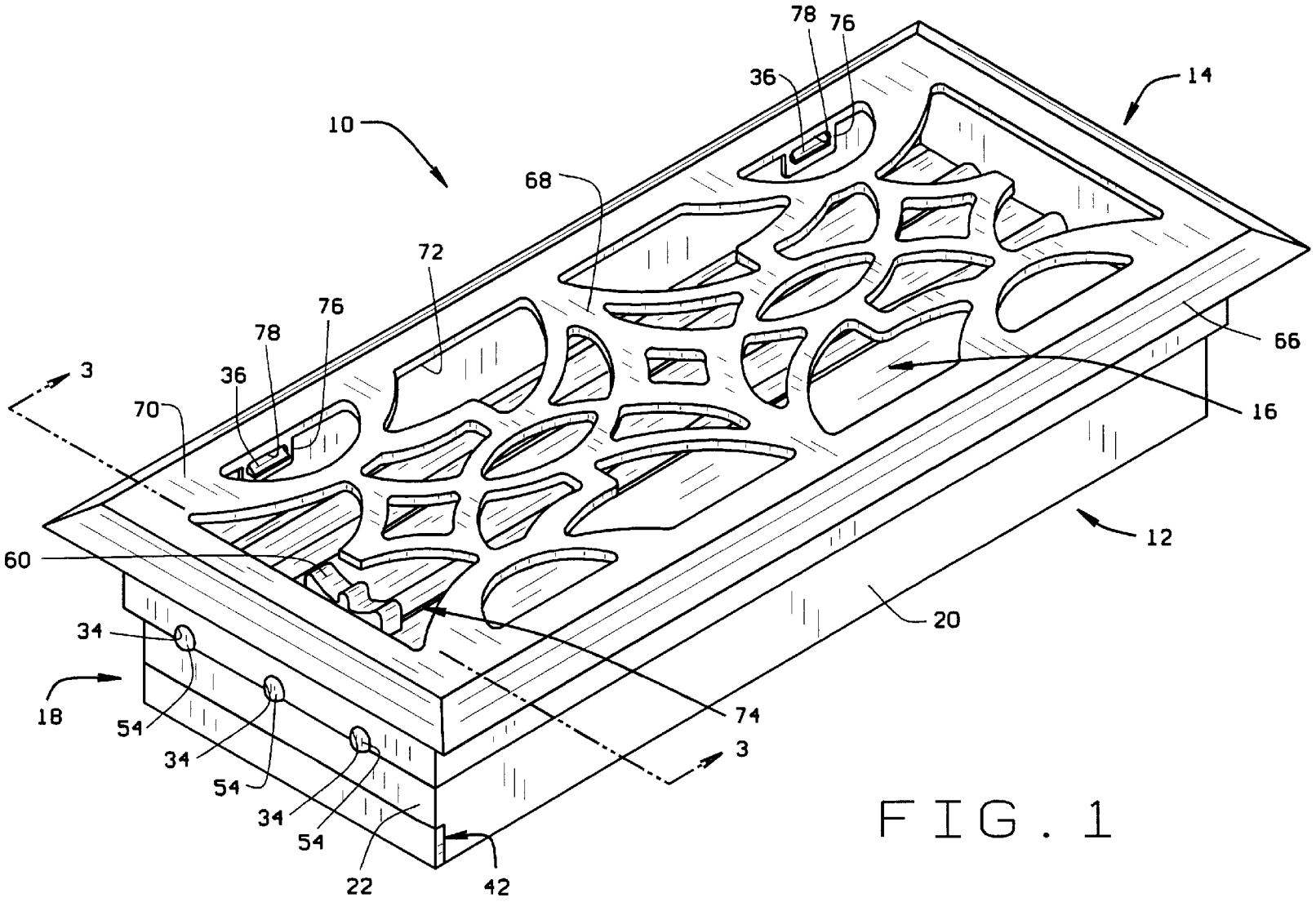
FIG. 1 is a perspective view of the register assembly of the invention.
Figure 2:
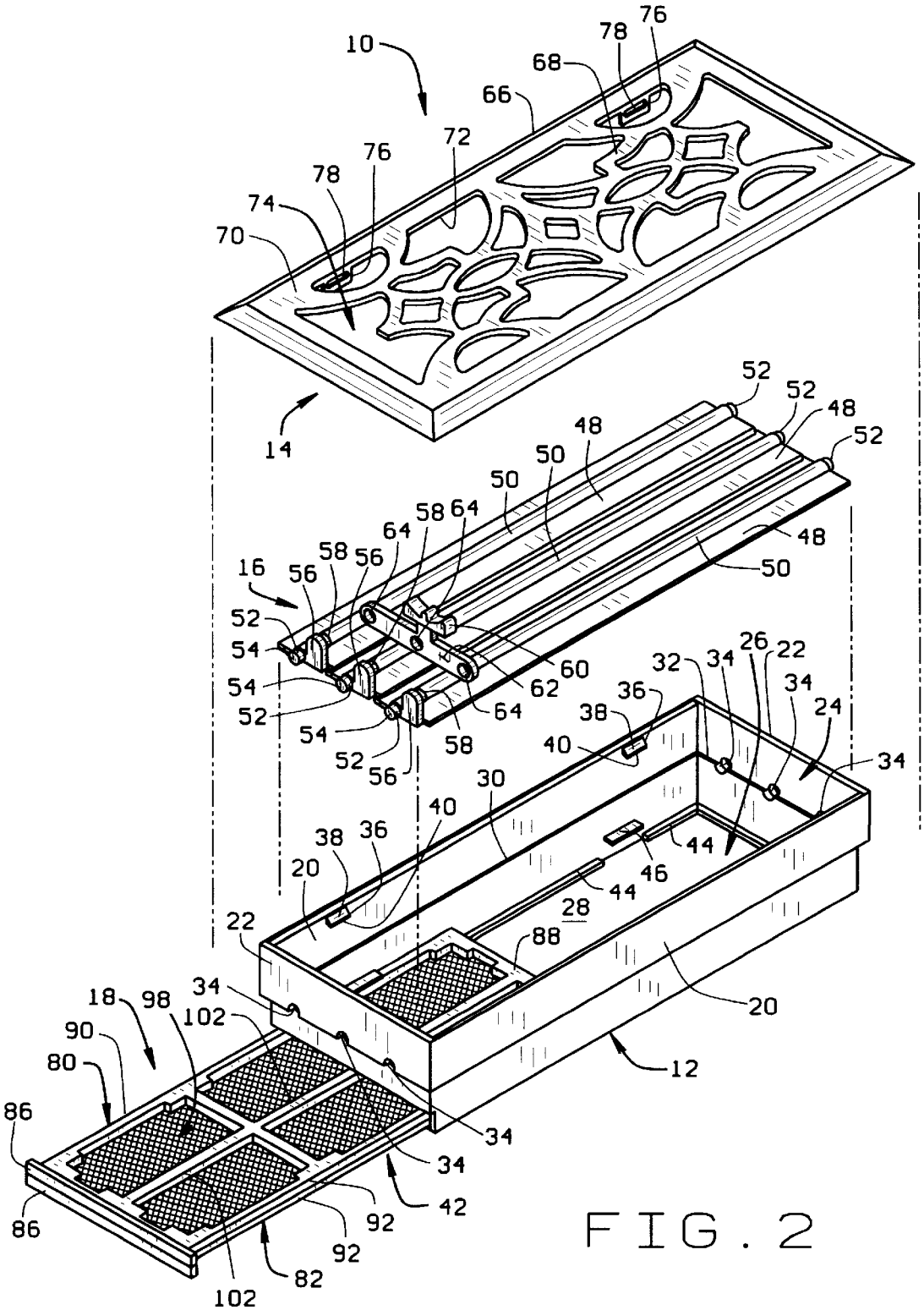
FIG. 2 is an exploded view of the register assembly showing its component parts.

The register assembly of the present invention is shown in its assembled condition in FIG. 1 and shown disassembled in FIG. 2. The register assembly 10 is basically comprised of a base 12, a faceplate 14, a damper mechanism 16, and a filter frame 18. In one preferred embodiment of the invention the base, faceplate, damper mechanism and filter frame are all formed from a semi-rigid plastic. In an alternate embodiment of the invention the faceplate 14 is constructed of wood, ceramic or a metal such as brass. The component parts of the register assembly are equally well-suited for being constructed of other materials. However, the plastic construction of the base, damper mechanism and filter frame significantly reduces the manufacturing cost of these component parts and reduces the register assembly's purchase price to the ultimate consumer.

The base 12 is comprised of a first pair of longitudinally extending sidewalls 20 and a second pair of laterally extending sidewalls 22 that together give the base a boxlike configuration. The base is formed as a monolithic unit. The top edges of the sidewalls surround a top opening 24 of the base and bottom edges of the sidewalls surround a bottom opening 26 of the base. The base has a hollow interior 28 between its top and bottom openings. The longitudinal sidewalls 20 have top and bottom sections with the bottom section being spaced inwardly from the top section by longitudinal shoulders 30 that extend along the lengths of the sidewalls. In a like manner, the lateral sidewalls 22 of the base also have top and bottom sections with the bottom sections being space inwardly from the top sections by laterally extending shoulders 32. By forming the four base sidewalls with bottom sections that are spaced inwardly from the top sections a number of the bases, with their faceplates 14, damper mechanisms 16 and filter frames 18 disassembled, can be nested together one on top of the other with the bottom sections of the nested base sidewalls being received inside the top sections of the nested base sidewalls reducing the area needed for storage or shipment of the bases.

The opposite lateral sidewalls 22 have a number of mutually opposed holes 34 spacially arranged along the lateral shoulders 32. The holes 34 receive stub shafts of the damper mechanism to be described.

The opposite longitudinal sidewalls 20 have a number of pawls 36 that project inwardly from the interior surfaces of the sidewalls. In the embodiment shown in the drawings there are two pawls 36 that project inwardly from each longitudinal sidewall 20. The pawls 36 have top surfaces 38 that slope downwardly as the pawls project inwardly from the sidewalls and bottom surfaces 40 that are perpendicular to the interior surfaces of the sidewalls 20. The pawls 36 are used to removable attach the faceplate 14 over the base top opening 24 in a manner to be described.

A filter slot opening 42 is provided in one of the lateral sidewalls 22 of the base. The slot opening extends entirely across the lateral sidewall 22 between the longitudinal sidewalls 20 and has a height dimension that corresponds to the height dimension of the filter frame 18 to be described. The filter slot 42 passes entirely through the sidewall 22 into the base interior 28.

A lower shoulder 44 projects a short distance into the base interior 28 from the bottom edges of the four sidewalls 20, 22. The lower shoulder 44 extends entirely around the base bottom opening 26 except for four segments of the shoulder that are absent.

Upper shoulders 46 project inwardly toward the base interior 28 from the interior surfaces of the two longitudinal sidewalls 20. The upper shoulders 46 are positioned directly above the absent segments of the lower shoulder 44. In the preferred embodiment, there are two upper shoulders 46 on each longitudinal sidewall 20. The upper shoulders 46 are spaced a distance above the lower shoulders 44 that corresponds to the height of the filter slot 42 and the height of the filter frame 18 to be described.

The damper mechanism 16 in the preferred embodiment is comprised of three dampers 48, although fewer or more dampers may be employed provided the number of pairs of holes 34 in the lateral sidewalls 22 are consistent with the number of dampers. Each damper 48 is a generally flat, rectangular member having a reinforcing ridge 50 running longitudinally down its center. The longitudinal length of each damper 48 is slightly less than the longitudinal length of the base interior 28. The combined lateral widths of the dampers 48 is slightly smaller than the lateral width of the base interior 28 with there being a slight lateral overlap between adjacent dampers.

Stub shafts 52 project from the opposite ends of each of the dampers 48. The distal ends 54 of the stub shafts 52 have a longitudinal spacing that is slightly larger than the longitudinal distance between the lateral sidewalls 22. A crank arm 56 projects upwardly from each of the stub shafts 52. Each crank arm 56 has a pin 58 at its distal end that projects toward the dampers 48.

A manual actuator 60 is operatively connected to the pins 58 of the crank arms 56. The actuator 60 is connected to a lateral bar 62 that has three spacially arranged holes 64 therethrough. The crank arm pins 58 are inserted through the actuator holes 64, thereby mounting the manual actuator 60 on the crank arms 56. * The faceplate 14 has a rectangular border 66 that surrounds an ornamental grid 68. The ornamental grid 68 shown in the drawings is only one example of the ornamentation of the faceplate. It should be understood that the faceplate grid 68 could have a variety of different designs. In the embodiment shown, the border 66 slopes downwardly as it extends outwardly from the grid 68. The periphery of the border 66 is slightly larger than the base top opening 24 as is conventional in register assemblies that are inserted into air duct openings in order for the border 66 to conceal the air duct opening. The grid 68 has a generally flat top surface 70 and a generally flat bottom surface 72. The ornamental design of the grid 66 provides several openings through the faceplate 14 for the passage of air therethrough. One of these openings 74 serves as the actuator opening of the register assembly.

Four tabs 76 project downwardly from the faceplate bottom surface 72. The number of tabs 76 corresponds to the number of pawls 36 on the base. The tabs 76 are also positioned on the faceplate bottom surface 72 in laterally and longitudinally spaced positions that position the tabs directly above the pawls 36 when the faceplate 14 is positioned above the base top opening 24. The tabs 76, whether constructed of plastic, wood, metal or some other material, are constructed with a thickness that enables the tabs to resiliently flex inwardly when attaching the faceplate 14 onto the base 12 as will be explained. Holes 78 pass through each of the tabs 76 and are dimensioned sufficiently large to receive the pawls 36 therethrough. The numbers of tabs and pawls and their positions may vary depending on the size of the register assembly.

Figure 4:
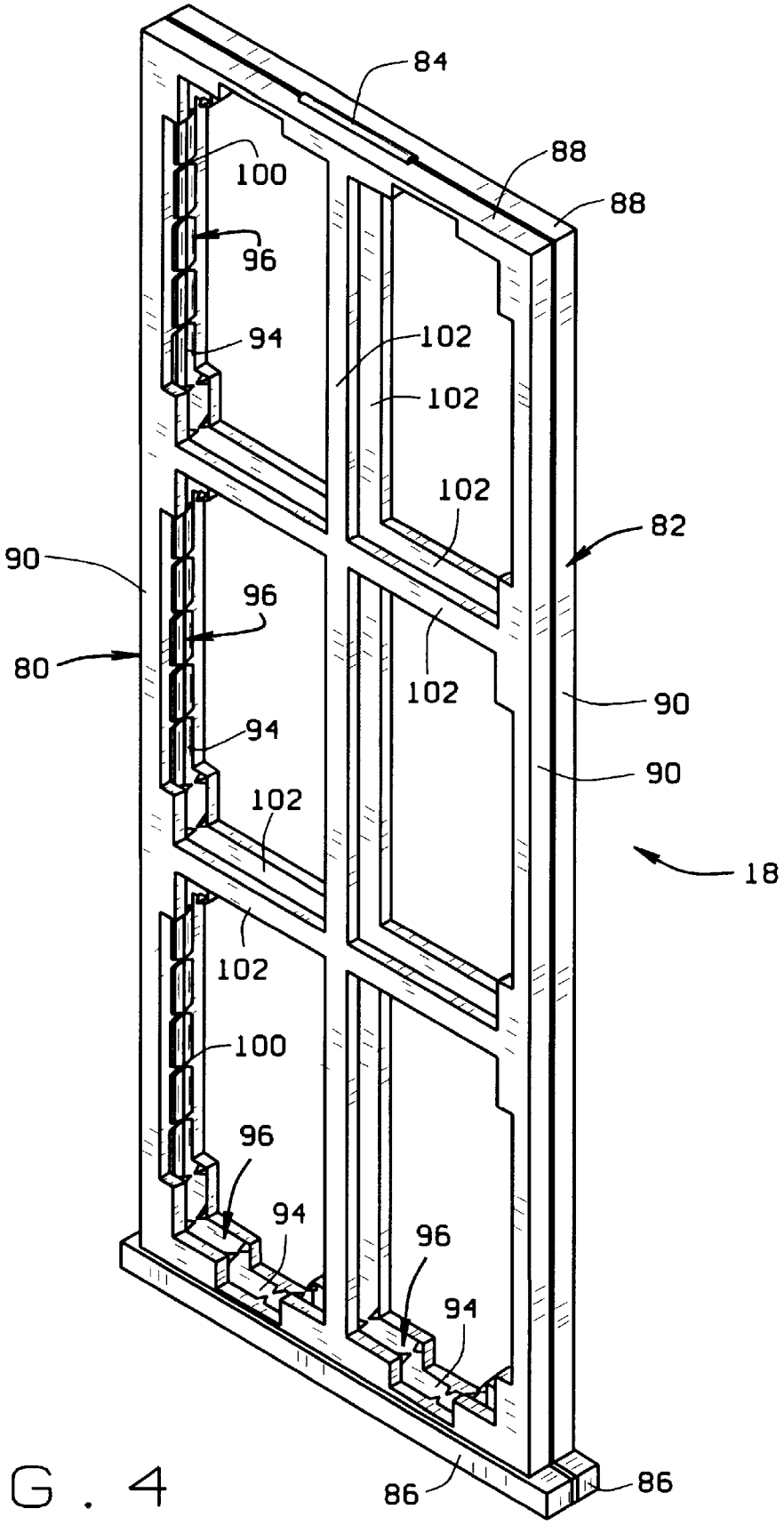
FIG. 4 is a perspective view of the filter frame.
Figure 7:
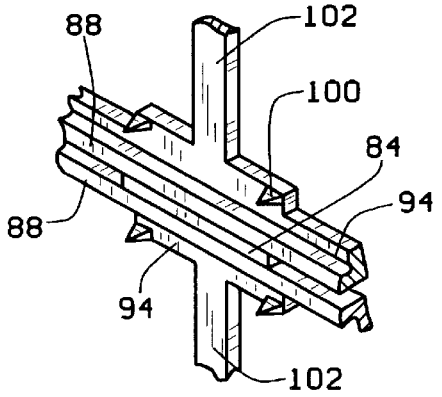
FIG. 7 is a detailed partial view of the frame.

The filter frame 18 is shown partially removed from the base 12 in FIG. 2 and is shown completely removed from the base in FIG. 4. Details of the frame are shown in FIGS. 5–7.

Figure 5:
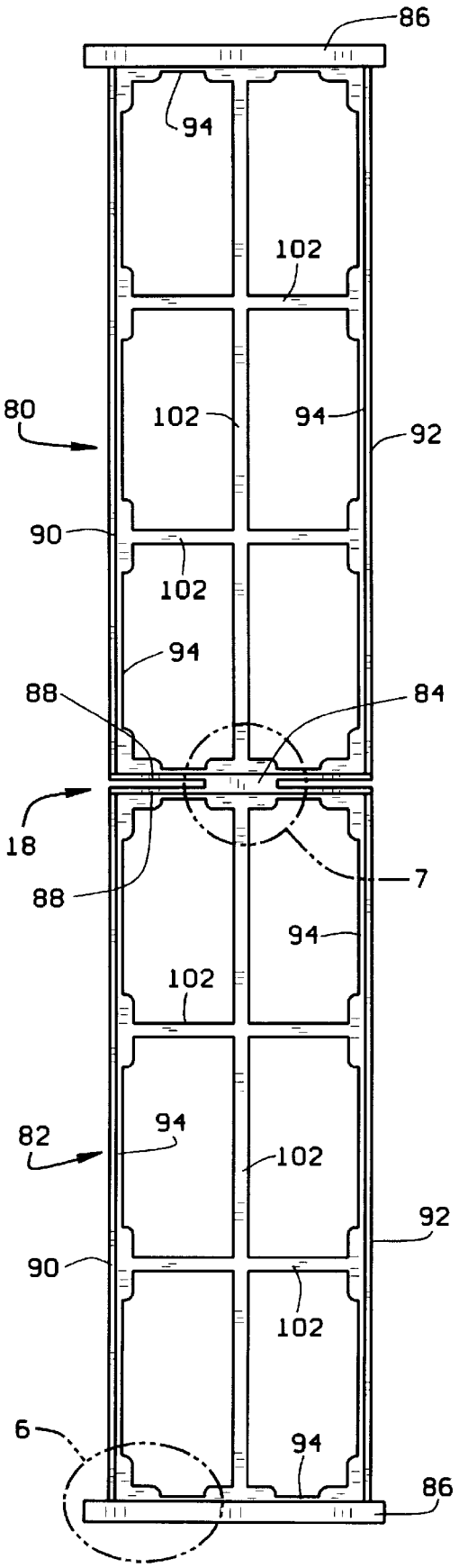
FIG. 5 is a plan view of the frame with its first and second sections unfolded.
Figure 6:
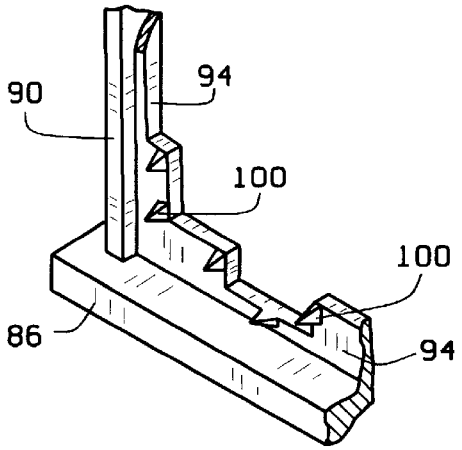
FIG. 6 is a detailed partial view of the frame.

As seen best in FIG. 5, the filter frame 18 is constructed of first 80 and second 82 sections that are mirror images of each other. The two sections are molded of rigid plastic in the preferred embodiment of the invention and are connected together at one end by a hinge 84 cast monolithicaly from the same plastic of the first and second frame sections. Each frame section is rectangular and its periphery is defined by a lateral handle 86 at one end, a lateral border 88 at the opposite end, and two longitudinally extending borders 90, 92. A peripheral ledge 94 extends around each frame section and projects inwardly from the borders. The ledge 94 has a lesser thickness than the four borders so that when the two frame sections are pivoted about the hinge 84 to their closed position shown in FIG. 4, there is a spacing 96 left between the peripheral ledges of the two sections and the borders of the two sections lay flush against each other.

The peripheral spacing 96 is provided to receive a rectangular piece of filter material 98 having a rectangular configuration dimensioned to fit within the borders of the frame sections and between the peripheral ledges 94 of the frame sections. The filter material 98 may be woven or spun fiber material, loosely matted fiber material, a plastic foam or a paper filter provided that it is pliable and permeable with sufficient porosity so as to not restrict a free flow of air therethrough. The peripheral ledge 94 is also provided with a plurality of spines 100 spacially arranged along the ledge. The spines 100 project inwardly when the first 80 and second 82 sections of the frame are folded over on each other with the filter material 98 therebetween and partially penetrate into the filter material 98 holding it taunt around the periphery of the frame 18. The frame sections are also provided with a plurality of cross-braces 102 that lay over opposite sides of the filter material 98 when the frame sections are closed and thereby support the filter material.

In assembling the base 12, faceplate 14, damper mechanism 16 and filter frame 18 together, the filter material 98 is positioned between the frame first section 80 and second section 82 as the sections are folded over onto each other about the hinge 84. With the filter material 98 secured between the two frame sections, the frame is then inserted into the filter slot 42 and between the upper 46 and lower 44 shoulders of the base. With the filter frame 18 inserted to its fullest extent through the slot, the filter material 98 covers over the base bottom opening 26 and is supported in the base interior 28 by the upper 46 and lower 44 shoulders. The frame can be easily removed from the base and the filter material is easily removed from the frame to allow its cleaning or replacement. It is not necessary that the filter slot and frame be positioned at the bottom of the base as shown. In variant embodiments of the invention the filter frame could be positioned between the faceplate and damper mechanism.

Figure 3A:
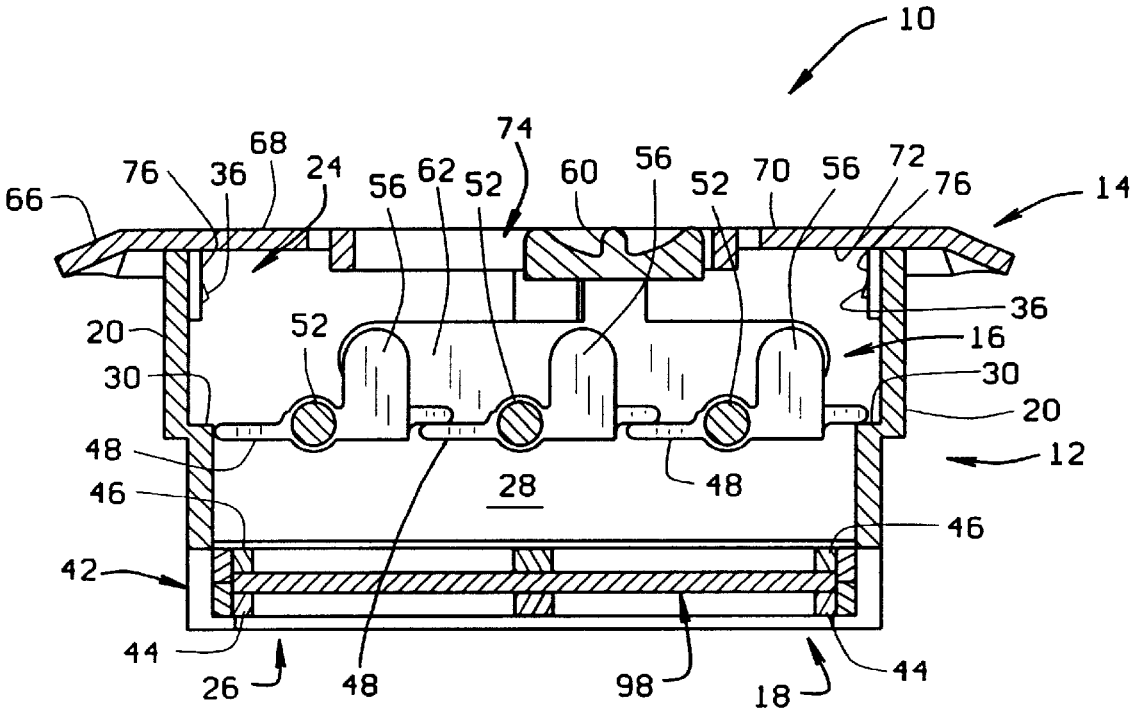
FIG. 3A is a side elevation view, in section, taken along the line 3—3 of FIG. 1 showing the damper in its closed position.
Figure 3B:
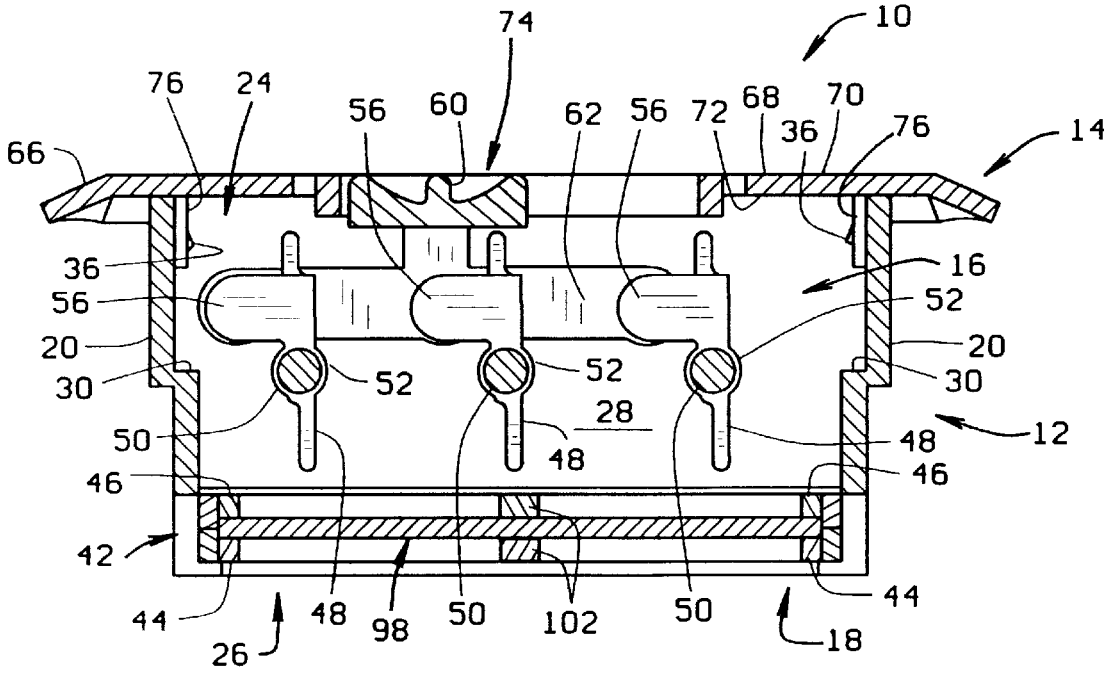
FIG. 3B is a view similar to that of FIG. 3A but showing the damper in its open position.

The dampers 48 are individually positioned in the base interior 28 and their stub shafts 52 are inserted into opposed holes 44 in the lateral sidewalls 22 of the base. Because the distal ends 54 of the stub shafts 52 are positioned further apart than the lateral sidewalls 22 of the base, the dampers must be bent slightly in order to snap-fit their stub shafts 52 into the holes 34. As the dampers are assembled in the base interior, they are arranged so that they overlap each other in the manner shown in FIG. 3A. Dampers are preassembled into bases by the manufacturer and are shipped nested together to save space. The actuators are shipped separately and are later assembled to the dampers.

The manual actuator 60 is then assembled onto the crank arms 56 of the dampers. The lateral bar 62 is positioned adjacent the crank arm pins 58 and is pressed against the pins so that the pins snap into the actuator holes 64.

The faceplate 14 is then positioned over the base top opening 24 with each of the tabs 76 positioned above a pawl 36. The faceplate 14 is pressed downwardly onto the base top opening 24 causing the tabs 76 to ride over the angled top surfaces 38 of the pawls which causes the tabs to flex inwardly toward the base interior 28. The faceplate 14 is continued to be moved downwardly onto the base top opening 24 until the pawls 36 align with the tab holes 78 causing the tabs 76 to resiliently snap back over the pawls 36 with the pawls 36 projecting through the tab holes 78. In this manner, the pawls 36 and the tabs 76 provide snap-on connectors between the faceplate 14 and the base 12. The faceplate 14 can be removed from the base 12 and replaced with another faceplate if desired by pulling the faceplate 14 away from the base 12 with sufficient force to cause the tabs 76 to flex inwardly and disengage the pawls 36.

The register assembly of the invention described above is inexpensively manufactured and can easily be assembled without the use of fasteners. It provides the beneficial features of a filter and a removable faceplate that enables various ornamental designs of the faceplate grid to be used on the same base. Because it is possible to form most or all of the component parts of plastic, the cost of manufacture of the register assembly is significantly reduced which also results in a reduction in cost to the ultimate purchaser.

While the present invention has been described by reference to a specific embodiment, it should be understood that modifications and variations of the invention may be constructed without departing from the scope of the invention defined in the following claims.

What is claimed:

1. A register assembly for covering an air duct opening, the register assembly comprising:

a base having a boxlike shape with a first pair of spaced, opposed sidewalls and a second pair of spaced, opposed sidewalls enclosing an interior of the base, the base having top and bottom openings providing access to the base interior, one of the sidewalls having a filter slot therethrough;

at least one damper is mounted on the base for movement of the damper between a closed position where the damper blocks a free flow of air through the base interior, and an open position where the damper does not block the free flow of air through the base interior;

a filter that is inserted into and removable from the filter slot, the filter extending across the base interior between the top and bottom openings;

a faceplate is removably attached to the base across the opening, the faceplate has a top surface and a bottom surface, a number of tabs project downwardly from the faceplate bottom surface and each tab has a hole therein; and a number of pawls equal to the number of tabs project inwardly from the base sidewalls toward the base interior and into the holes in the tabs.

2. The register assembly of claim 1, wherein:

the base has upper and lower shoulders in the base interior that engage against opposite sides of the filter inserted into the base filter slot and hold the filter in the base interior.

3. The register assembly of claim 1, wherein:

at least a pair of dampers is mounted on the base and each of the dampers has a pair of stub shafts projecting from opposite ends of the damper and one of the pair of opposed sidewalls has pairs of holes therein, the stub shafts of the dampers are received in the holes mounting the dampers for pivoting movement between their closed and opened positions.

4. The register assembly of claim 3, wherein:

the face plate has an actuator opening;

one stub shaft of each of the dampers has an arm secured thereto, the arm extends to a distal end that is operatively connected to an actuator in the face plate actuator opening, where the operative connection of the arm to the actuator causes the stub shaft to move in a pivoting motion in response to the actuator being moved in a linear motion.

5. The register assembly of claim 3, wherein:

the stub shafts projecting from the opposite ends of each damper have distal ends that are spaced a first distance apart and the one of the pairs of opposed sidewalls with the holes therein are spaced a second distance apart that is less than the first distance.

6. The register assembly of claim 1, wherein:

the tabs are constructed of a resilient material that enables the tabs to flex inwardly toward the center of the base interior and pass over the number of pawls when the faceplate is pulled from the base top opening.

7. The register assembly of claim 1, wherein:

the first pair of sidewalls have top and bottom sections and the bottom sections are positioned inwardly of the top sections;

the second pair of sidewalls have top and bottom sections and the bottom sections are positioned inwardly of the top sections; wherein a pair of like bases are nestable with the sidewall bottom sections of one base of the pair inserted through the base top opening and into the base interior inside the sidewall top sections of the other base of the pair.

8. The register assembly of claim 1, wherein:

the filter is held taunt across the openings of the first and second frame sections by the four borders of the first and second frame sections.

9. The register assembly of claim 1, wherein:

a border of the first frame section is hinged to a border of the second frame section.

10. The register assembly of claim 1, wherein:

the base has an upper shoulder in its interior and a lower shoulder in its interior, the upper shoulder engages against one of the first and second frame sections and the lower shoulder engages against the other of the first and second frame sections and hold the frame in the base interior.

11. A register assembly for covering an air duct opening, the register assembly comprising:

a base having a boxlike shape with a first pair of spaced, opposed sidewalls and a second pair of spaced, opposed sidewalls surrounding an interior of the base, the base having top and bottom openings to the base interior, the first pair of mutually opposed sidewalls are spaced a first distance apart and have at least one pair of mutually opposed holes therein;

a filter extending across the base interior;

a faceplate secured to the base over the top opening, the faceplate having an actuator opening, the faceplate also having a top surface and a bottom surface, a number of tabs project outwardly from the faceplate bottom surface and each tab has a hole therein;

a number of pawls equal to the number of tabs project inwardly from the base sidewalls toward the base interior and into the holes in the tabs, thereby securing the faceplate to the base;

at least one damper in the base interior, the damper having a pair of stub shafts that project from opposite sides of the damper to distal ends of the stub shafts spaced a second distance apart that is greater than the first distance and that are received in the pair of holes in the first pair of sidewalls thereby mounting the damper for pivoting movement in the base interior, the damper also having an arm projecting from the damper toward the base top opening; and an actuator positioned in the faceplate actuator opening and operatively connected to the arm to cause pivoting movement of the damper in response to linear movement of the actuator in the actuator opening.

12. The register assembly of claim 11, wherein:

the first pair of sidewalls have top and bottom sections and the bottom sections are positioned inwardly of the top sections;

the second pair of sidewalls have top and bottom sections and the bottom sections are positioned inwardly of the top sections; wherein a pair of like bases are nestable with the sidewall bottom sections of one base of the pair inserted through the base top opening and into the base interior inside the sidewall top sections of the other base of the pair.

13. A register assembly for covering an air duct opening, the register assembly comprising:

a base having a boxlike shape with a first pair of spaced, opposed sidewalls and a second pair of spaced, opposed sidewalls enclosing an interior of the base, the base having top and bottom openings providing access to the base interior, one of the sidewalls having a filter slot therethrough;

at least one damper mounted on the base for movement of the damper between a closed position where the damper blocks a free flow of air through the base interior, and an open position where the damper does not block the free flow of air through the base interior;

a faceplate removably attached to the base across the opening;

a frame that is insertable into and removable from the filter slot, the frame having first and second frame sections, the first and second frame sections each having a periphery defined by four borders that extend around at least one opening;

a filter positioned between the first and second frame sections, the filter spanning across the openings of the first and second frame sections and being pressed between the four borders of the first and second frame sections, the filter being held taunt across the openings of the first and second frame sections by the four borders of the first and second frame sections; and a plurality of spines arranged around the four borders of the first and second frame sections, the plurality of spines engage with the filter in holding the filter taunt across the openings of the first and second frame sections.

* * * * *